US005294152A

United States Patent [19]

Jacobs

[11] Patent Number: 5,294,152

[45] Date of Patent: Mar. 15, 1994

[54] SKI POLE STRAP

[76] Inventor: Thomas Jacobs, 630 Glen St., Queensbury, N.Y. 12804

[21] Appl. No.: 843,283

[22] Filed: Feb. 27, 1992

[51] Int. Cl.[5] ..... A63C 11/22

[52] U.S. Cl. ..... 280/821; 280/822

[58] Field of Search ..... 280/821, 819, 820, 822; 294/25

[56] References Cited

U.S. PATENT DOCUMENTS

| | | | |
|---|---|---|---|
| D. 180,913 | 9/1957 | Mossop | D21/230 |
| D. 290,865 | 7/1987 | Rustad | D21/230 |
| 3,862,765 | 1/1975 | Goheen | 280/11.37 |
| 3,879,048 | 4/1975 | Penney | 280/11.37 |
| 4,061,347 | 12/1977 | Stern et al. | 280/821 |
| 4,114,911 | 9/1978 | Laird et al. | 280/11.37 |
| 4,172,601 | 10/1979 | Hutter | 280/11.37 |
| 4,288,102 | 9/1981 | Ramer | 280/823 |
| 4,416,036 | 11/1983 | Aho | 24/136 |
| 4,493,494 | 1/1985 | Feagin, Jr. | 280/821 |
| 5,123,674 | 6/1992 | Bagneres et al. | 280/821 |

FOREIGN PATENT DOCUMENTS

| | | | |
|---|---|---|---|
| 9014136 | 11/1990 | World Int. Prop. O. | 280/821 |

OTHER PUBLICATIONS

The Swix Alpine Poles Brochure.

*Primary Examiner*—Joseph D. Pape

*Attorney, Agent, or Firm*—Ronald P. Kananen

[57] ABSTRACT

A ski pole handle strap comprising a main wrist strap forming a loop and a secondary thumb strap connected to the main strap which divides the loop into first and second loops such that the wrist of a skier is retained by the first loop and the thumb of the skier is retained by the second loop. If a skier's grasp on the wrist strap is lost the thumb strap retains the ski pole close enough to the skier's hand to allow the skier to regain their grip.

12 Claims, 6 Drawing Sheets

SKI POLE STRAP

FILED OF THE INVENTION

This invention relates to a ski pole handle strap and more particularly, to a handle strap with a thumb grip strap.

DESCRIPTION OF PRIOR ART

In the conventional ski straps, as shown in U.S. Pat. Nos. 3,862,765; 4,114,911, and 4,288,102, a hand and forefingers are laced from the underneath through a strap in the shape of a loop and the hand is closed over the strap from above to insure a tight grip for slalom racing, for example, or downhill racing. Problems arise, however, when the hand grip slips from the strap as a result of hitting pole, for example, and skiers cannot in the heat of competition and at the subject speeds regain their grip on the strap. The strap hangs too far from the skier's hand. Merely shortening the strap does not solve this problem since the strap must be large enough to fit around the skier's hand and allow the skier to grasp the pole. Thus, it is a problem in the prior art to provide a ski wrist strap which allows skiers to easily regain their grip on the strap after their grip is lost.

SUMMARY OF THE INVENTION

It is an object of the present invention to provide an improved ski strap which allows skiers to more easily retain their grip after their grip is lost.

It is an object of the present invention to provide a ski grip arrangement such that if a skier's grip on the strap is lost, a thumb grip strap retains the ski pole close enough to the skier's hand that the grip can be restored.

Additional objects, advantages and novel features of this invention will be set forth in the description which follows, and will become apparent to those skilled in the art upon reading this description or practicing the invention. The objects and advantages of the invention may be realized and attained by the appended claims.

To achieve the foregoing and other objects, in accordance with the present invention, as embodied and broadly described herein, the ski pole handle strap of the present invention may comprise a main wrist strap forming a loop, one end of which is attached to the handle grip of a ski pole, and a secondary thumb strap, one end of which is connected to the ski pole and the other end o which is connected to the main strap so as to divide the loop into a first loop of a length to fit around the wrists of skiers and a second loop of a length to fit around the thumb of skiers such that if the skiers lose their grip on the wrist strap, the thumb strap retains the pole close enough to the skier's hand that the grip can be restored.

BRIEF DESCRIPTION OF DRAWING

The accompanying drawings, which are incorporated in, and form part of, the specification, illustrate an embodiment of the present invention and, together with the description sure to explain the principle of the invention. In the drawings.

DETAILED DESCRIPTION OF THE PREFERRED EMBODIMENT

Reference will now be made in detail to the preferred embodiment of the invention, an example of which is illustrated in the accompanying drawings.

Figure 1:
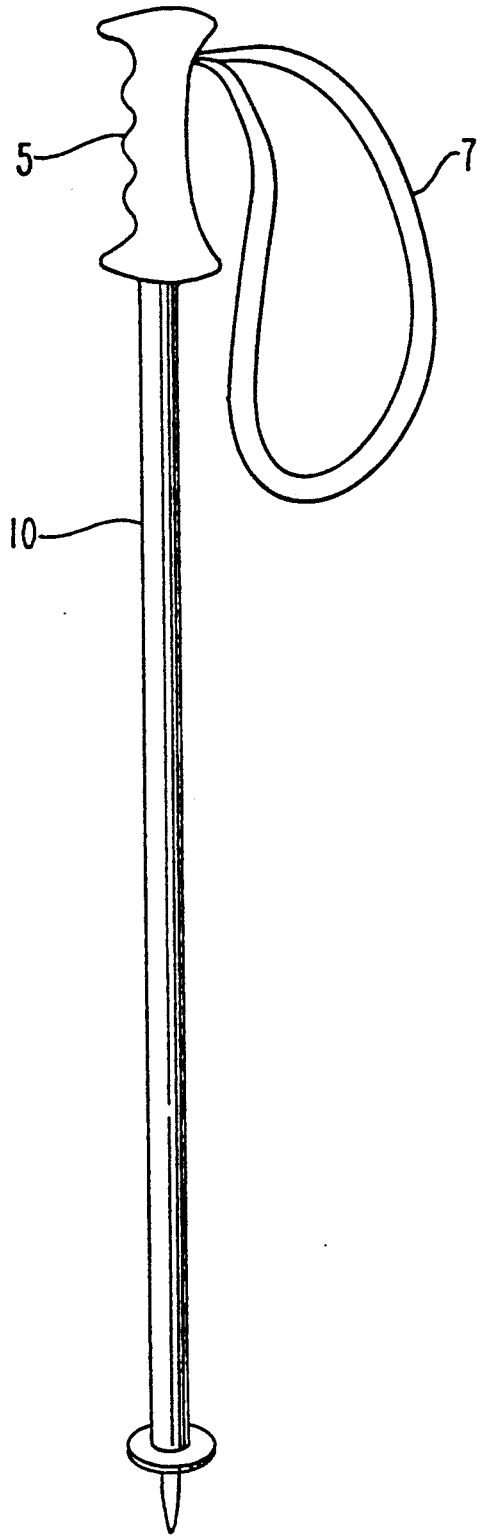
FIG. 1 (PRIOR ART)
FIG. 1 is a view of the ski pole handle strap of the prior art.

The ski pole and strap of the prior art is shown in FIG. 1. A ski pole is represented at 10, a conventional grip 5 is attached to the pole 10, and a strap 7 is attached at the upper portion of the grip 5 to retain a skier's wrist close to the pole so that the pole is not lost while skiing.

Figure 2:
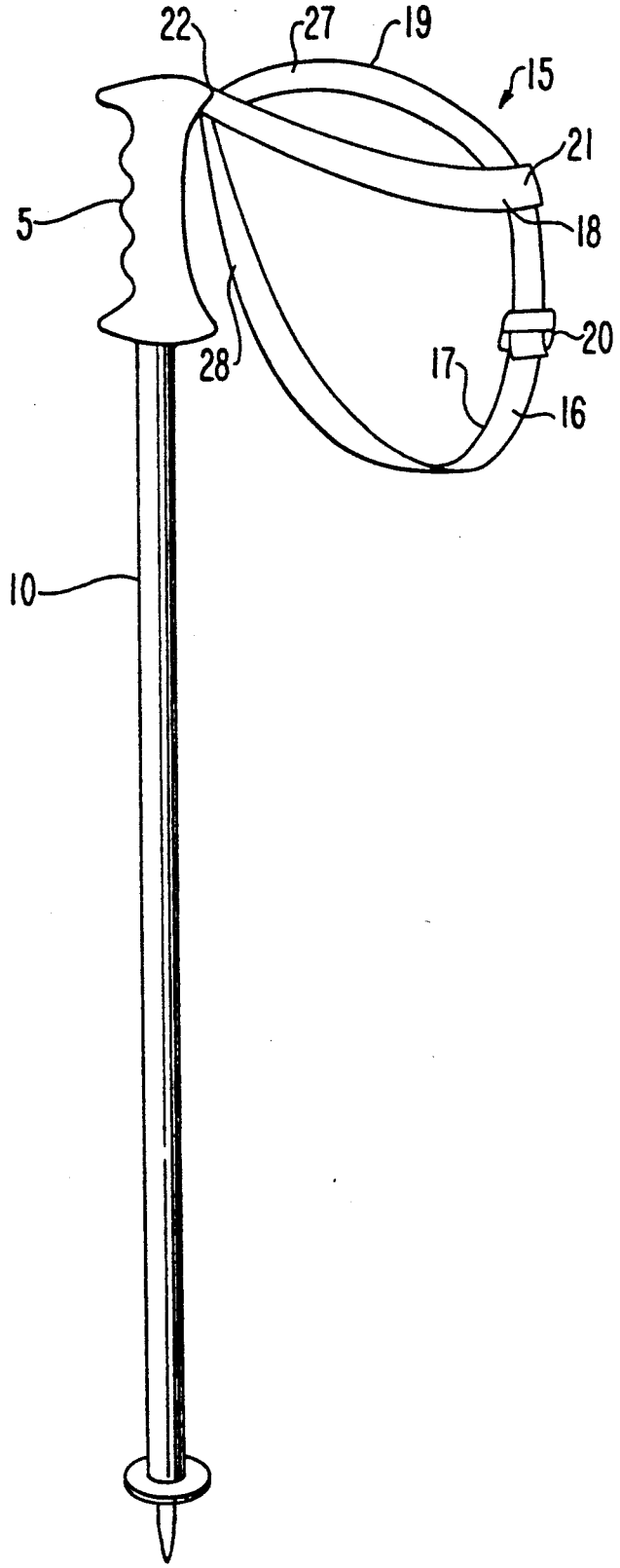
FIG. 2 is a view of the ski pole handle strap of one embodiment of the present invention.

Illustrated in FIG. 2 is the ski wrist strap of the present invention. A conventional ski pole 10 and grip 5 are shown. The ski pole can be used for alpine skiing including downhill, super giant slalom, and slalom. The wrist strap of the preferred embodiment of the present invention is shown generally at 15. The ski strap 15 is comprised of a first wrist retaining means to retain a skier's wrist in connection with the ski pole 10. Preferably, such means comprise a main strap 16. The ski strap 15 is also comprised of a second thumb retaining means to retain the ski pole 10 closer to a skier's grasp than does the first retaining means. Preferably such means comprise a thumb strap 18.

The main strap 16 forms a main loop one end of which is attached to the grip 5 at 22 in the conventional manner. One end of the secondary strap 18 is attached to the grip 5 at 22 in the conventional manner. The other end of the secondary strap 18 is attached to the main strap 16 at 21 so as to divide the main loop into a first loop 17 of a length to fit around the wrist of a skier and a second loop 19 of a length to fit around the thumb of a skier.

Figure 6:
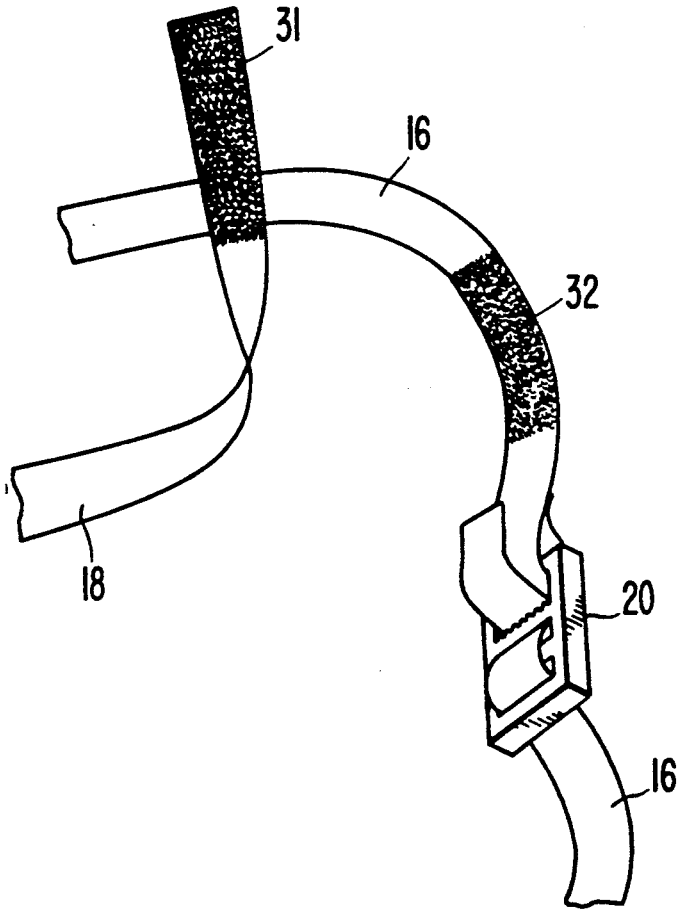
FIG. 6 is an enlarged view of a VELCRO brand hook and loop type connection means which may be used with the present invention.

The connection means shown in FIG. 2 at 21 is VELCRO brand hook and loop type fastener. It should be recognized, however, that any suitable connection means could be used, such as rivets or stitching. In addition, the connection at 21 can be permanent or adjustable. When the connection is adjustable the size of the second loop 19 can be varied to fit the thumb of different sized skiers. A VELCRO brand hook and loop type adjustable connection is shown in FIG. 6. In FIG. 6, hooks are shown at 31 and loops are shown at 32. A permanent rivet connection is shown at 21 in FIG. 4. The connection 21 may also be removed for free skiing when skiers may not need the pole retained so closely to their grip. The connection can then be applied for competitive skiing such as slalom gate skiing when the skiers need the pole retained closely to their grip.

The main strap 16 can also be fitted with an adjustable fastener shown at 20 so that the size of the first loop can be increased or decreased in order to fit the hand of different sized skiers. The fastener shown at 20 can be of the conventional belt and loop type fastener.

Figure 5:
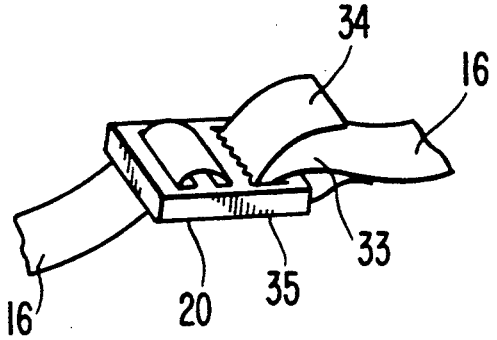
FIG. 5 is an enlarged view of an adjustable fastener which may be used with the present invention.

An adjustable fastener 20 which may be used in the present invention is shown in more detail in FIG. 5. One end 33 of the main strap 16 is attached to the fastener 20.

Another end 34 of main strap 16 is weaved through the fastener 20. The length of strap 34 put through the fastener 20 may be adjusted depending on the size of the skier. The fastener 20 has teeth 35 to retain the strap 34 in place during use.

In using the ski strap of the present invention, the hands and forefingers of a skier are laced from underneath through the first loop 17 and the skier's thumb is laced from underneath through the second loop 19. The skier's hand can then grasp the portion of the main strap 16 indicated at 27 and 28 and the grip 5 of the ski pole 10. By providing the thumb strap 18 in addition to the main strap 16, if the skier's grip is lost, the thumb strap retains the ski pole close enough to the skier's hand that the grip can be restored. This can be seen more clearly in FIGS. 3 and 4 which show a skier's hand through the ski strap of FIG. 2. The strap 18 retains the pole close enough to the skier's hand 25 or 26, that the skiers can easily recover their grip.

Figure 3:
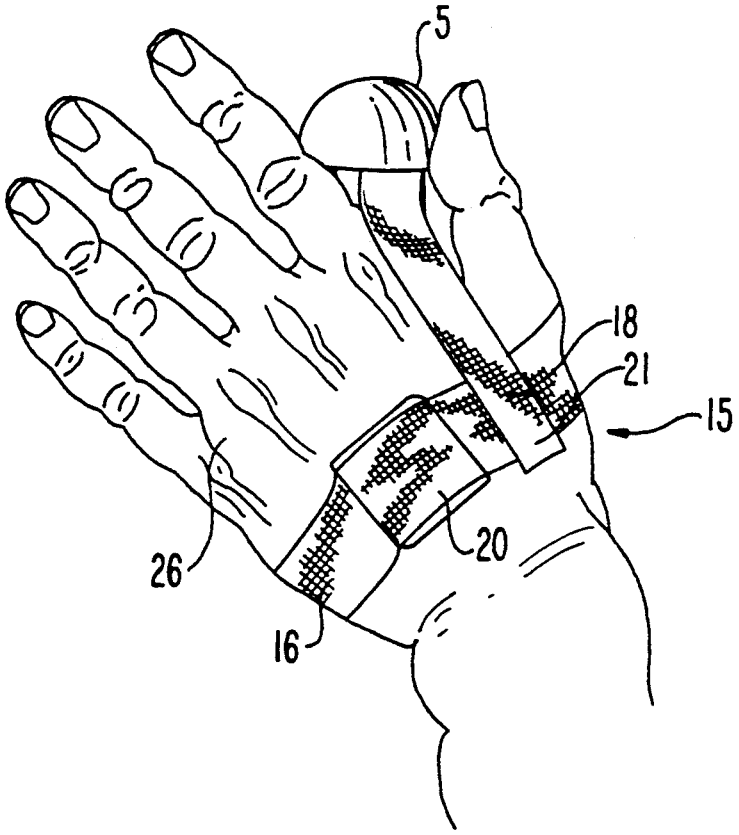
FIG. 3 is a perspective view, illustrating the ski pole handle strap of the present invention along with a skier's hand.
Figure 4:
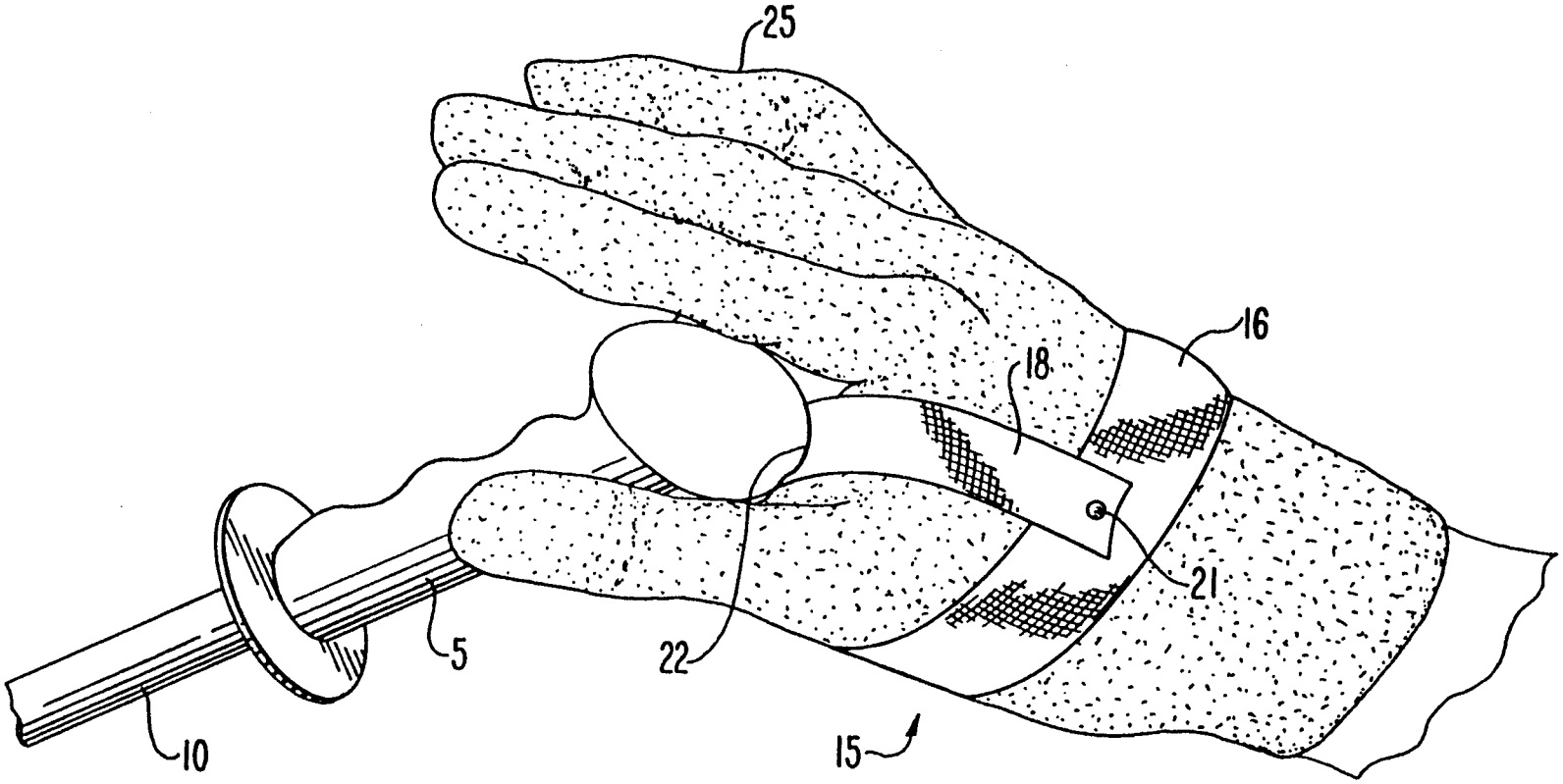
FIG. 4 is another perspective view, illustrating the ski pole handle strap of the present invention along with a skier's hand.

FIGS. 3 and 4 also illustrate another feature of the instant invention. The ski strap 15 can be worn on a gloved hand 25 as shown in FIG. 4 or on a bare hand 26 as shown in FIG. 3. The ski strap is adaptable to fit all users.

Thus, according to the present invention, if skiers lose their wrist grip such as by striking a slalom gate, they can recover their wrist grip because the second loop prevents the pole handle from traveling too far from their grasp.

We claim:

1. A ski pole handle strap for use in combination with a ski pole having a handle grip comprising:

a first retaining means which is gripped by a skier for retaining a skier's wrist in proximity of said ski pole so that the ski pole is not lost while skiing, wherein said first retaining means comprise a main wrist strap forming a main loop of a length to fit around the wrist of a skier, and wherein one end of said main loop is attached to said handle grip of said ski pole; and a second retaining means for retaining the skier's thumb nearer to said ski pole than said first retaining means such that if said grasp on said first retaining means is lost, the second retaining means retains said ski pole within the grasp of the skier such that the skier can easily recover said grasp, wherein said second retaining means comprise a secondary thumb strap, one end of which is attached to said handle grip of said ski pole, the other end of which is attached to said main wrist strap so as divide said main loop into a first loop sized to fit around the wrist of a skier and a second loop smaller than said first loop sized to fit around the thumb of a skier, whereby the wrist of a skier is retained by the first loop and the thumb of a skier is retained by the second loop, said strap being structurally adapted to be worn on a gloved hand or on a bare hand, whereupon said second loop prevents said pole handle from traveling too far from a skier's grasp to recover a grip on said pole.

2. A ski pole handle strap as defined in claim 1, wherein said secondary thumb strap is attached to said main wrist strap by an adjustable fastener such that the length of the second loop is adjustable.

3. A ski pole handle strap as defined in claim 1, wherein said secondary thumb strap is attached to said main wrist strap by means of VELCRO Brand hook and loop type fastener.

4. A ski pole handle strap as defined in claim 1, wherein said secondary thumb strap is attached to said main wrist strap by means of a rivet.

5. A ski pole handle strap as defined in claim 1, wherein said main wrist strap contains adjustment means for varying the length of the first loop to fit different skiers.

6. A ski pole handle strap as defined in claim 4, wherein said adjustment means comprise a belt and loop type fastener.

7. A ski pole handle strap structurally adapted to be worn on a gloved hand or on a bare hand, for use in combination with a ski pole having a handle grip, comprising:

a main wrist strap forming a loop, one end of said loop being attached to said handle grip of said ski pole; and a secondary thumb strap, one end of which is attached to said handle grip of said ski pole, the other end of which is attached to said main wrist strap so as to divide said loop into a first loop sized to fit around the wrist of a skier and a second loop smaller than said first loop sized to fit around the thumb of a skier, said first and second loops being separate from and adapted to be worn on a gloved hand or a bare hand, whereby the wrist of a skier is retained by the first loop and the thumb of a skier is retained by the second loop.

8. A ski pole handle strap as defined in claim 7, wherein said secondary thumb strap is attached to said main wrist strap by an adjustable fastener such that the length of the second loop is adjustable.

9. A ski pole handle strap as defined in claim 7, wherein said secondary thumb strap is attached to said main wrist strap by means of a rivet.

10. A ski pole handle strap as defined in claim 7, wherein said secondary thumb strap is attached to said main wrist strap by means of VELCRO Brand hook and loop type fastener.

11. A ski pole handle strap as defined in claim 7, wherein said main wrist strap contains adjustment means such that the length of the first loop can be varied to fit different skiers.

12. A ski pole handle strap as defined in claim 11, wherein said adjustment means comprise a belt and loop type fastener.

* * * * *